United States Patent [19]

Maki et al.

[11] Patent Number: 4,739,644

[45] Date of Patent: Apr. 26, 1988

[54] PROCESS FOR FORMING INTERNAL GEAR PROFILE CUP-SHAPED MEMBER AND APPARATUS THEREFOR

[75] Inventors: Toshio Maki; Masao Kuramitsu; Kaoru Yamanoi, all of Sayama, Japan

[73] Assignee: Honda Giken Kogyo Kabushiki Kaisha, Tokyo, Japan

[21] Appl. No.: 947,737

[22] Filed: Dec. 30, 1986

[51] Int. Cl.[4] ..... B21C 23/03; B21K 1/76

[52] U.S. Cl. ..... 72/359; 72/264; 29/159.2

[58] Field of Search ..... 72/264, 349, 351, 352, 72/354, 359, 363; 29/159.2

[56] References Cited

U.S. PATENT DOCUMENTS

| | | | |
|---|---|---|---|
| 3,861,191 | 1/1975 | Sato et al. | 72/354 |
| 4,166,373 | 9/1979 | Braun | 72/359 |

FOREIGN PATENT DOCUMENTS

| | | | |
|---|---|---|---|
| 0117213 | 8/1984 | European Pat. Off. | 72/359 |
| 2325837 | 12/1973 | Fed. Rep. of Germany | 29/159.2 |
| 3433515 | 4/1985 | Fed. Rep. of Germany | 72/264 |
| 48-4809 | 2/1973 | Japan . | |
| 005106 | 1/1980 | Japan | 29/159.2 |
| 3716831 | 3/1981 | Japan | 29/159.2 |
| 58-48258 | 10/1983 | Japan . | |
| 60-99448 | 6/1985 | Japan | 29/159.2 |

*Primary Examiner*—Robert L. Spruill
*Assistant Examiner*—Donald R. Studebaker
*Attorney, Agent, or Firm*—Armstrong, Nikaido, Marmelstein & Kubovcik

[57] ABSTRACT

A cup-shaped raw workpiece having a bottom panel and a cylindrically-shaped circumferential panel is positioned facing downwardly on a movable lower punch having a forming gear profile. The lower punch is provided in a die having an orifice portion which together with the gear profile defines an orifice. A resilient mechanism resists downward movement of the lower punch. An upper punch is lowered to hold the bottom panel of the workpiece against the lower punch and pushes the workpiece to extrusion form the inner surface thereof through the orifice. An escape groove for excess metal can be provided in the bottom inside corner of the workpiece at the juncture of the circumferential panel and the bottom panel. The lower punch can be provided with an upwardly extending protrusion near the outer circumferential edge of the upper end surface thereof which has an outer chamfered circumferential edge.

5 Claims, 4 Drawing Sheets

PROCESS FOR FORMING INTERNAL GEAR PROFILE CUP-SHAPED MEMBER AND APPARATUS THEREFOR

BACKGROUND OF THE INVENTION

This invention relates to a forming process for forming, by forging, an internal gear profile cup-shaped member such as an outer casing of hydraulic pressure operated clutch or the like, and an apparatus for the same.

As for a process of this kind, there has been hitherto known a push-in forming process such as disclosed in Japanese Patent Application Sho No. 58-48258. In this process, a gear profile punch is pushed into an opening of a cup-shaped raw workpiece to contact the inner surface of the circumferential panel thereof and form it. An extrusion process is known where a solid raw workpiece is extruded to protrude rearwards by a gear profile punch. An ironing process is known where an outer surface fo the circumferential panel of a cup-shaped raw workpiece is ironed.while an inner surface of the circumferential panel is restrained by a gear profile punch.

However, the push-in type process has problems in that there is a restriction in gear shape usable. In addition it is extremely difficult to obtain an effective forming of the internal shape extendin9 all of the way to the bottom surface of the cup-shaped member. In the push-in type process, the punch suffers a remarkable amount of abrasion and is short in service life. The extrusion type process has problems in that a high forming load is required. Especially, a gear forming work on a large diameter solid raw workpiece by cold forging is disadvantageous in that not only a large-sized pressing machine is required, but also a stress involved is so large that abrasion of the punch is further increased. The ironing type process has no problems with respect to abrasion of the punch but has problems especially in such a case where the internal gear profile punch is large in size and high in height, the movement of the metal of the raw material of the workpiece caused by outer circumferential ironing tends to be exclusively in the vertical direction, and not in the circumferential direction, so that a perfect gear-shape forming is extremely difficult to obtain.

OBJECT AND SUMMARY OF THE INvENTION

This invention has for its purpose to provide a process for forming an internal gear profile cup-shaped member free from the foregoing conventional problems.

The invention is characterized in that a cup-shaped raw workpiece is set, with its circumferential panel being directed downwards, on an upper end portion of a lower punch which is provided at its circumferential surface with a forming gear profile and is so supported in a die as to be movable downwards against the action of a resilient means, and then an upper punch opposite to the lower punch is lowered so that, under the condition that a bottom panel portion of the cup-shaped raw material is held from above and below between the two punches, the circumferential panel of the cup-shaped raw material may be pushed into an orifice defined by an orifice portion formed on an inner circumferential surface of the die for effecting an extrusion forming thereof and forming an internal gear profile following the forming gear profile formed on the outer circumferential surface of the lower punch

BRIEF EXPLANATION OF THE DRAWINGS

The above and other objects and the attendant advantages of the present invention will become readily apparent by reference to the following detailed description when considered in conjunction with the accompanying drawings wherein.

DETAILED DESCRIPTION OF PREFERRED EMBODIMENT

Figure 1:
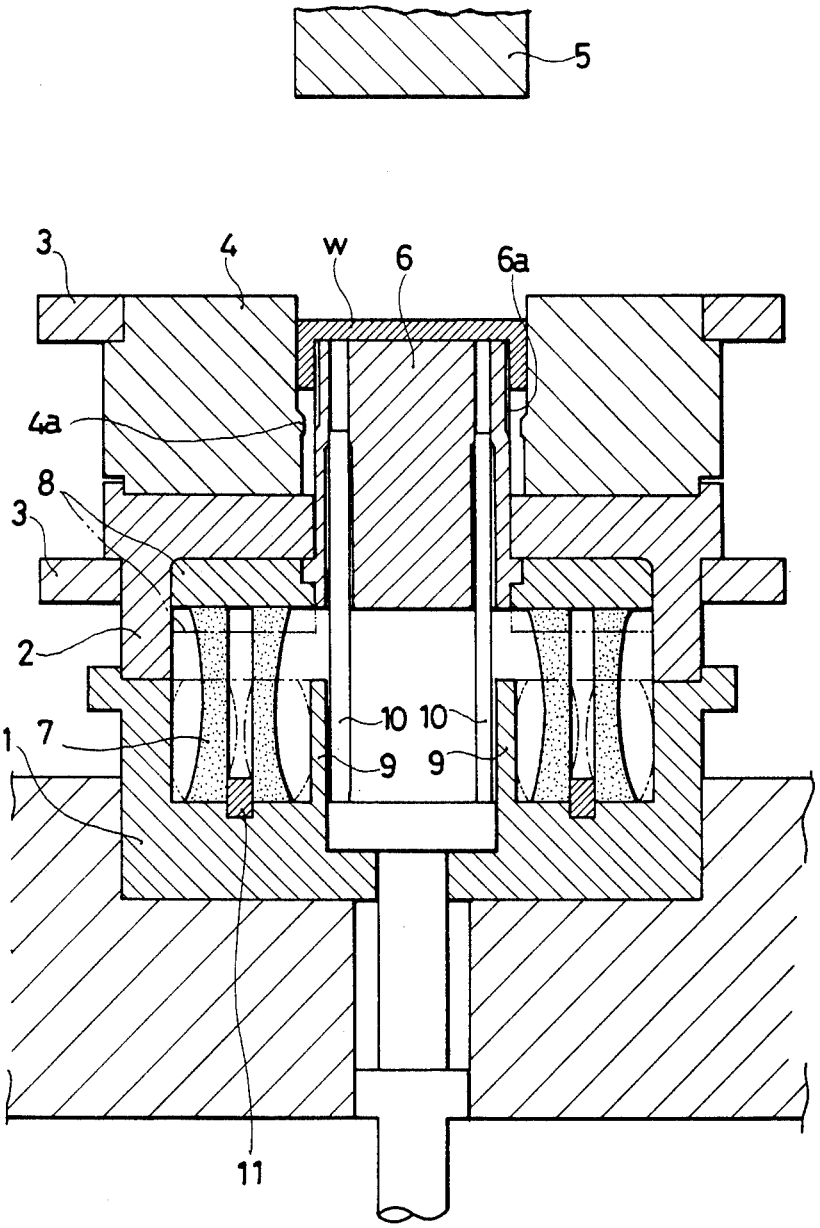
FIG. 1 is a sectional view of one example of an apparatus for carrying out one embodiment of a process of this invention.

Now, embodying examples of this invention process will be explained with reference to the accompanying drawings:

FIG. 1 shows one example of an apparatus for carrying out one embodiment of this invention process. The apparatus comprises a die 4 which is provided on its inner circumferential surface with an orifice portion 4*a* and which is attached, through upper and lower stationary rings 3, 3, to a back plate 2 on a die holder 1, an upper punch 5 mounted from above in the die 4, and a lower punch 6 mounted in the die 4. The lower punch 6 is provided on its outer circumferential surface with a forming gear profile 6*a*. The lower punch 6 is supported in an upright posture on a supporting plate 8 which in turn is supported by a resilient means comprising a plurality of cylindrical springs 7 made of urethane, for instance. Thus, the lower punch may be moved downwards against the action of these springs 7. The lowest position of the movement of the lower punch 6 is restrained by the abutment of the supporting plate 8 with a stopper 9 provided on the die holder 1.

Knock-out pins 10 are inserted through openings in the lower punch 6 and can be slidably moved therealong upwards and downwards. A positioning means 11 is provided for setting the foregoing resilient means 7 in position.

Figure 2A:
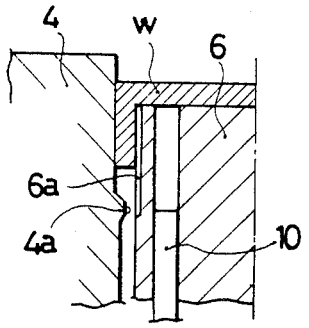
FIG. 2(*a*)–(*3*) is a brief diagram showing a progress of a forming process of this invention.
Figure 2B:
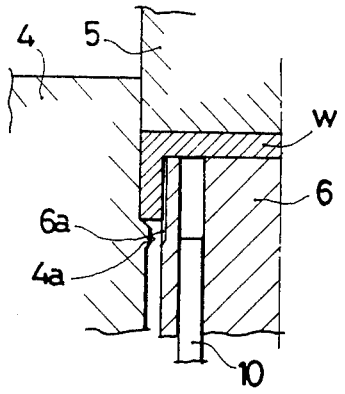
Figure 2C:
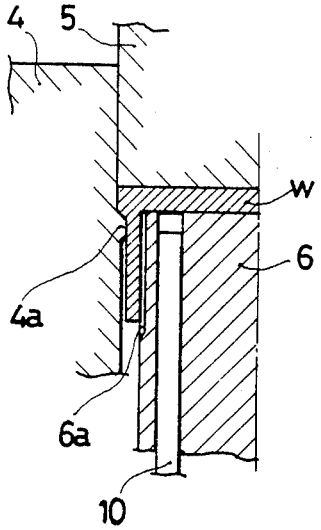

Next, a process for forming an internal gear type cup-shaped member by using the foregoing apparatus will be explained with reference to FIG. 2 as follows:

Firstly, as shown in FIG. 2*a*, a cup-shaped raw workpiece w is set, with its circumferential panel being directed downwards, on an upper end portion of the lower punch 6. The upper punch 5 is lowered, so that, as shown in FIG. 2*b*, a bottom panel portion of the cup-shaped raw workpiece w is brought to be held from above and below between the two punches 5, 6. Under this condition, the lower punch 6 is lowered against the action of the resilient means 7 and, as shown in FIG. 2c, the circumferential panel of the raw workpiece w is pushed into an orifice formed by the orifice portion 4a of the die 4. The metal of the circumferential panel of the raw workpiece w is inserted and forced into the orifice so as to be extruded downwards by a pressure applied thereto from above, while being squeezed inwards by the orifice portion 4a of the die. Thus, there is carried out a forward extrusion forming. In this manner, internal gear-like teeth wa following the forming gear profile 6a formed on the outer surface fo the circumferential panel of the lower punch 6 are formed on the inner circumferential surface of the cup-shaped raw workpiece w.

In the course of this extrusion forming operation, when the moving speed of the metal of the raw workpiece through the orifice becomes higher than the descending speed of the upper punch 5, and consequentily the lower punch 6 is applied with a downwardly pushing force caused by its friction with the moving metal of the raw workpiece, and as a result the lower punch 6 is moved downwardly by the downwardly pushing force faster than the upper punch 6 is descending, the force for holding the bottom panel portion of the raw workpiece w by the two punches 5, 6 is decreased. Accordingly, the bottom panel portion of the workpiece tends to curve or bend into a spherical form. In such case, an accurate internal gear profile cannot be formed. Accordingly, as a countermeasure, the resilient force of the resilient means 7 is set to be larger than this downwardly pushing force. In this manner, the lowering in the force for holding the bottom panel portion by the two punches can be prevented.

Figure 2D:
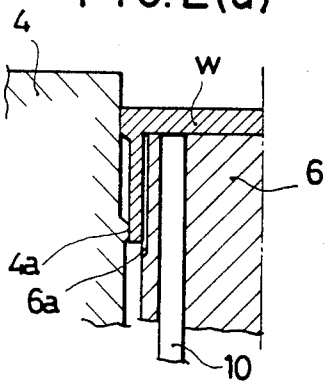
Figure 2E:
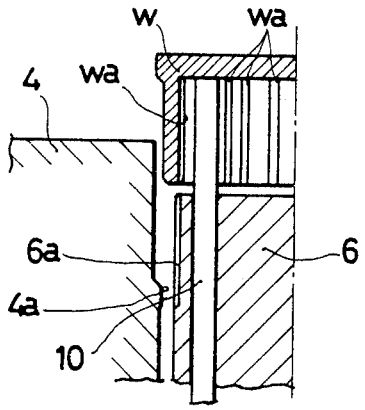

After the extrusion forming, the upper punch 5 is elevated and then the lower punch 6 is also elevated to a predetermined position as shown in FIG. 2d. The knockout pins 10 are then elevated for taking out the product as shown in FIG. 2e.

Figure 3A:
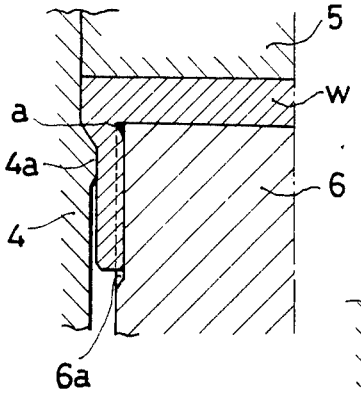
FIG. 3 (*a*)–(*c*) are sectional views showing respective modes of forming of an important portion of a cup-shaped raw workpiece at a final stage of application of pressure.
Figure 3B:
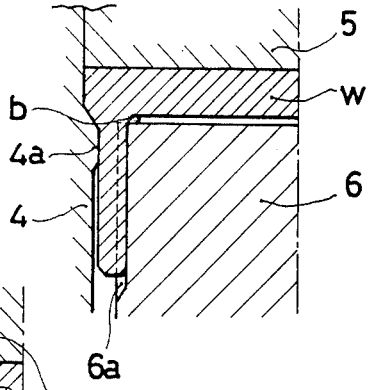
Figure 3C:
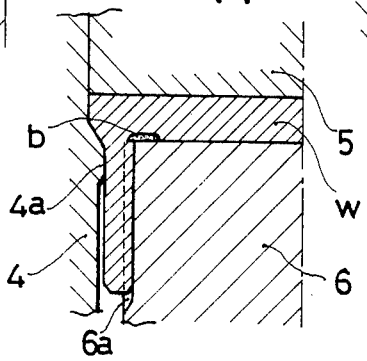

In the course of the foregoing extrusion forming, a recessed portion a is liable to be left at an opening bottom corner of the internal gear teeth wa as shown in FIG. 3a. In order to fill this recessed portion a with metal, if the upper punch 5 is further lowered from the condition shown in FIG. 3a, it often happens that, as shown in FIG. 3b, excess metal b is projected inwards from the opening bottom corner of the cup-shaped raw workpiece w, while the lower punch 6 is being pushed downwards. Consequently, when the lower punch 6 reaches the lowermost position regulated by the stopper 9 and the raw workpiece w is applied with a final pressing, the excess metal b is thrust into the bottom of the cup-shaped raw workpiece w to spoil the product.

In this case, as a preventive measure the resilient force of the resilient means 7 could be increased to prevent the lower punch 6 from lowering caused by the projection of the excess metal b. This, however, is not advantageous, because if the resilient means 7 is increased in resilient force, the forming load is increased to that extent.

Figure 4A:
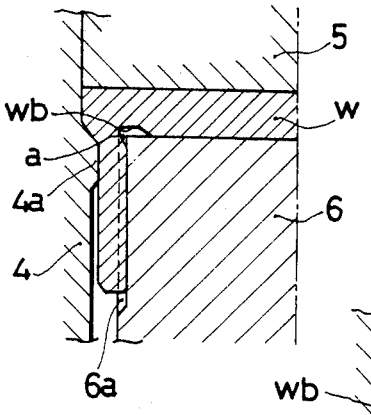
FIG. 4 (*a*)–(*c*) are sectional views showing respective modes of forming of the important portion of the cup-shaped raw workpiece at the final pressure stage in a case where an escape groove is previously made in the cup-shaped raw workpiece.
Figure 4B:
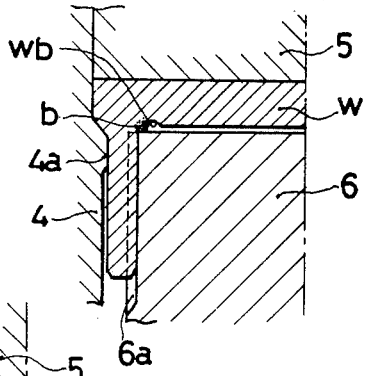
Figure 4C:
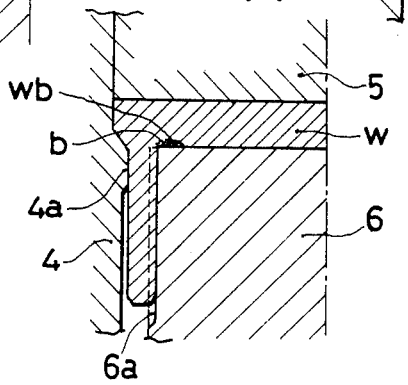

Another embodying example of this invention for avoiding this problem advantageously will be explained with reference to FIG. 4 as follows:

Namely, the raw workpiece w is previously provided at its opening bottom corner portion with an escape groove wb so that when the upper punch 5 is further lowered from the condition that the recessed portion a is left unfilled as shown in FIG. 4a, even if excess metal b is projected while the lower punch 6 is being pushed downwards as shown in FIG. 4b, at the final pressing stage, the excess metal b may be received in the escape groove wb as shown in FIG. 4c. In this manner, the thrusting of the excess metal b into the bottom of the product may be prevented.

Figure 5A:
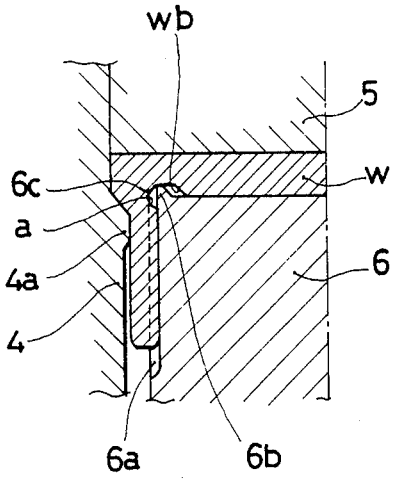
FIG. 5 (*a*)–(*c*) are sectional views showing respective modes of forming of the important portion of the cup-shaped raw workpiece at the final pressure stage in a case where a lower punch is provided with a protrusion.
Figure 5B:
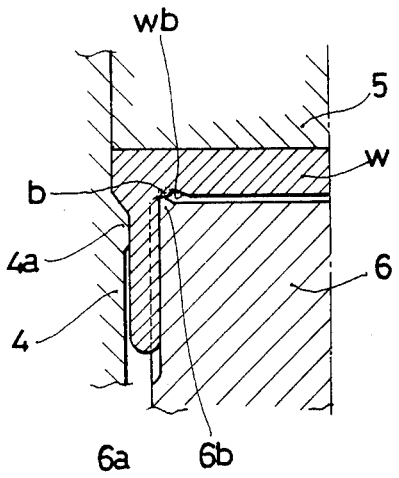
Figure 5C:
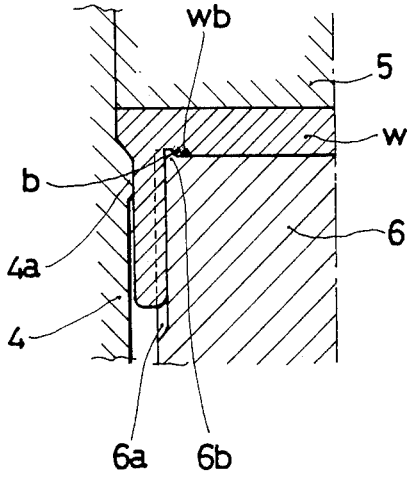

In this case, however, if, an upper end surface of the lower punch 6 is flat, an upper end of the forming gear profile 6a is liable to be worn, so that a perfect internal gear profile extending all of the way to the bottom surface of the finished cup-shaped workpiece cannot be obtained. Accordingly, a modified embodying example of this invention for removing this problem is shown in FIG. 5. Namely, a protrusion 6b having a chamfered portion 6c at its outer circumference portion is provided along on a circumferential edge portion of the flat upper end surface of the lower punch 6 so that when the raw workpiece w is set thereon, the protrusion 6b may be inserted into the escape groove wb in such a manner that a gap is left on the inner side of the protrusion 6b as shown in FIG. 5a. Consequently, when the upper punch 5 is further lowered from the condition that the recessed portion a is left unfilled, the excess metal b may be received in the gap left on the inner circumferential side of the protrusion 6b at the final stage through the condition that the excess metal moves beyond the protrusion 6b as shown in FIG. 5b. In this embodiment, the movement of metal can be facilitated by the chamfered portion 6c previously formed on the outer circumferential portion of the protrusion 6b. Abrasion of an upper end of the forming gear profile can be prevented by the protrusion 6b, and the internal gear teeth wa can be so formed that the effective length thereof extends substantially completely to the bottom furface of the cup-shaped product.

Thus, according to this invention, under the condition that a bottom panel portion of a cup-shaped raw workpiece is held between an upper punch and a lower punch, the raw workpiece is pushed into an orifice of a die for effecting an extrusion forming thereof, so that there can be accurately formed thereon an internal gear profile following a forming gear profile formed on an outer surface of the circumferential panel of the lower punch, and the amount of abrasion of the lower punch serving as a forming punch can be decreased and the forming punch can have an improved service life.

It is readily apparent that the above-described process for forming internal gear profile cup-shaped member and apparatus therefor meets all of the objects mentioned above and also has the advantage of wide commercial utility. It should be understood that the specific form of the invention hereinabove described is intended to be representative only, as certain modificatons within the scope of these teachings will be apparent to those skilled in the art.

Accordingly, reference should be made to the following claims in determining the full scope of the invention.

What is claimed is:

1. A process for forming an internal gear profile on a cup-shaped member comprising:

positioning a lower punch haivng an outer circumferential surface with a gear forming profile internally of a stationary die having a circular opening and a radially inward extending circumferential abutment in said die opening with resilient means opposing downward movement of said lower punch, setting a cup-shaped workpiece having a bottom panel and a cylindrically-shaped circumferential panel onto an upper end portion of said lower punch with said circumferential panel extending downwardly between said die and said lower punch, lowering an upper punch opposed to said lower punch downwardly to hold said bottom panel between a lower end portion of said upper punch and said upper end portion of said lower punch, and pushing said workpiece further into said die while holding said bottom panel between said upper punch and said lower punch such that said circumferential panel passes between said radially inward extending circumferential abutment and said gear profile of said lower punch effecting an extrusion forming of said circumferential panel to an internal gear-shaped profile following the gear profile on the outer circumferential surface of said lower punch.

2. The process according to claim 1, further comprising prior to setting said workpiece onto said lower punch, providing said cup-shaped raw workpiece with an internal groove extending around said bottom panel adjacent the juncture of said bottom panel with said cylindrically shaped circumferential panel.

3. The process according to claim 2 wherein said upper end portion of said lower punch is formed with an axially extending protrusion having a chamfered outer circumferential edge, and said cup-shaped workpiece is set on said lower punch with said protrusion extendin into a radially outer portion of said internal groove extending around said bottom panel of said workpiece with a gap being left on a radially inner side of said protrusion.

4. An apparatus for forming an internal gear profile on a cup-shaped member comprising:

a die having a circular opening, a pair of upper and lower punches movably mounted in said die with an annular workpiece receiving space between said die opening and said lower punch, and a radially inward extending circumferential abutment in said die opening, said lower punch having a gear forming outer circumferentia surface profile, said upper and lower punches being movable downward and resilient means for resisting downward movement of said lower punch, whereby said upper punch may be lowered to engage the bottom panel of a cup-shaped workpiece set on the upper end portion of the lower punch with a circumferent panel of said workpiece occupying said annular workpiece receiving space to hold the bottom panel between said upper and lower punches as said circumfere panel of said workpiece is pushed between said radially inwardly extending abutment and said gear forming outer profile of said lower punch thereby forming an internal gear profile on said circumferential panel.

5. An apparatus as claimed in claim 4, wherein a protrusion having an outer chamfered circumferential edge is provided at the upper circumferential edge portion of said lower punch.

* * * * *